US006729958B2

(12) United States Patent
Burns et al.

(10) Patent No.: US 6,729,958 B2
(45) Date of Patent: May 4, 2004

(54) GAMING SYSTEM WITH TICKET-IN/ TICKET-OUT CAPABILITY

(75) Inventors: James G. Burns, Las Vegas, NV (US); Robert R. Maxey, Las Vegas, NV (US)

(73) Assignee: MGM Grand, Inc., Las Vegas, NV (US)

( * ) Notice: Subject to any disclaimer, the term of this patent is extended or adjusted under 35 U.S.C. 154(b) by 43 days.

(21) Appl. No.: 10/119,791

(22) Filed: Apr. 10, 2002

(65) Prior Publication Data

US 2002/0160832 A1 Oct. 31, 2002

Related U.S. Application Data

(63) Continuation of application No. 09/541,180, filed on Apr. 3, 2000, which is a continuation of application No. 08/007,742, filed on Jan. 22, 1993, now Pat. No. 6,048,269.

(51) Int. Cl.[7] ..... A63F 9/24

(52) U.S. Cl. ..... 463/25; 463/29; 463/42

(58) Field of Search ..... 463/9–13, 16–17, 463/25, 29, 30, 36, 42, 43; 235/379–381, 375; 902/23; 700/91–93; 273/138.1, 138.2, 139, 143 R, 292–293, 236–237, 269

(56) References Cited

U.S. PATENT DOCUMENTS

| | | | |
|---|---|---|---|
| 3,124,674 A | 3/1964 | Edwards et al. | |
| 3,327,292 A | 6/1967 | Eriksson et al. | |
| 3,487,905 A | 1/1970 | James, Sr. et al. | |
| 3,560,715 A | 2/1971 | Osaka | 235/61.8 |
| 3,634,656 A | 1/1972 | Krechmer et al. | 235/61.7 B |
| 3,778,595 A | 12/1973 | Hatanaka et al. | 235/61.7 B |
| 3,786,234 A | 1/1974 | Trent et al. | 235/61.7 R |
| 3,810,627 A | 5/1974 | Levy | 273/138 A |
| 3,874,584 A | 4/1975 | Foley | 234/128 |
| 3,906,447 A | 9/1975 | Crafton | 340/149 A |
| 3,909,002 A | 9/1975 | Levy | 273/138 A |
| 3,958,103 A | 5/1976 | Oka et al. | 235/61.8 R |

(List continued on next page.)

FOREIGN PATENT DOCUMENTS

| | | | |
|---|---|---|---|
| AU | 555905 | 10/1986 | G07F/17/34 |
| DE | 34 41518 | 5/1981 | |
| DE | 34 06058 | 8/1985 | |
| EP | 150 103 | 1/1985 | A63F/9/00 |
| EP | 555 565 | 2/1992 | G07F/17/32 |

(List continued on next page.)

OTHER PUBLICATIONS

Berry, Kathleen M. "Hardware Makers Cash In On America's Betting Mania," *The New York Times*, Sep. 16, 1990. (p. F–4).

Boyd, C. "Modern Data Encryption" *Electronics and Communication Engineering Journal*, Oct. 1993 (pp. 271–278).

Complaint of Aristocrat Technologies, et al. dated Jan. 22, 2002.

(List continued on next page.)

*Primary Examiner*—Mark Sager
(74) *Attorney, Agent, or Firm*—Marshall, Gerstein & Borun LLP

(57) ABSTRACT

A gaming apparatus which comprises a slot machine capable of accepting either paper currency, preprinted coupons, or cash out slips. The slot machine also includes a printer that prints and dispenses cash out slips which include a bar code representing a unique identification that provides the amount of "winnings". The cash out slips can be scanned into a separate currency dispenser at a Cashier's Station for receiving currency, either from the dispenser or from an attendant. A central processing unit (CPU) generates the unique codes for regulating the game to be played, the wager limits of the game and the validity of the free play coupons or the cash out tickets. The above gaming system avoids having to use coins or tokens in the operation of slot machines.

12 Claims, 3 Drawing Sheets

U.S. PATENT DOCUMENTS 3,984,660 A 10/1976 Oka et al. ..... 235/61.7 B
4,032,946 A 6/1977 Wakatsuki et al. ..... 364/900
4,033,588 A 7/1977 Watts ..... 273/138 A
4,068,213 A 1/1978 Nakamura et al. ..... 340/149 A
4,072,930 A 2/1978 Lucero et al. ..... 340/152 T
4,108,361 A 8/1978 Krause ..... 235/375
4,108,364 A 8/1978 Tanaka et al. ..... 235/419
4,114,027 A 9/1978 Slater et al. ..... 235/419
4,124,109 A 11/1978 Bissell et al. ..... 194/4 R
4,206,920 A 6/1980 Weatherford et al. ... 273/138 A
4,240,635 A 12/1980 Brown ..... 273/138 A
4,254,404 A 3/1981 White ..... 340/311
4,275,456 A 6/1981 Tanaka et al. ..... 364/900
4,283,709 A 8/1981 Lucero et al. ..... 340/147 R
4,322,612 A 3/1982 Lange ..... 235/419
4,323,770 A 4/1982 Dieulot et al. ..... 235/375
4,335,809 A 6/1982 Wain ..... 194/1 R
4,339,798 A 7/1982 Hedges et al. ..... 364/412
4,373,726 A 2/1983 Churchill et al. ..... 273/138 A
4,467,424 A 8/1984 Hedges et al. ..... 364/412
4,494,197 A 1/1985 Troy et al. ..... 364/412
4,517,558 A 5/1985 Davids ..... 340/700
4,527,798 A 7/1985 Siekierski et al. ..... 273/86 R
4,531,187 A 7/1985 Uhland ..... 364/412
4,575,622 A 3/1986 Pellegrini ..... 235/382
4,626,672 A 12/1986 Sapitowicz et al. ..... 235/480
4,636,951 A 1/1987 Harlick ..... 362/412
4,648,600 A 3/1987 Olliges ..... 273/138 A
4,650,977 A 3/1987 Couch ..... 235/379
4,669,596 A 6/1987 Capers et al. ..... 194/210
4,669,730 A 6/1987 Small ..... 273/138 A
4,675,515 A 6/1987 Lucero ..... 235/381
4,689,742 A 8/1987 Troy et al. ..... 364/412
4,689,757 A 8/1987 Downing et al. ..... 364/550
4,700,296 A 10/1987 Palmer, Jr. et al. ..... 364/401
4,727,544 A 2/1988 Brunner et al. ..... 371/21
4,760,527 A 7/1988 Sidley ..... 364/412
4,764,666 A 8/1988 Bergeron ..... 235/380
4,775,937 A 10/1988 Bell ..... 364/412
4,782,468 A 11/1988 Jones et al. ..... 365/229
4,788,419 A 11/1988 Walters et al. ..... 235/381
4,809,837 A 3/1989 Hayashi ..... 194/205
4,815,741 A 3/1989 Small ..... 273/138 A
4,832,341 A 5/1989 Muller et al. ..... 273/139
4,856,787 A 8/1989 Itkis ..... 273/237
4,875,164 A 10/1989 Monfort ..... 364/412
4,880,237 A 11/1989 Kishishita ..... 273/138 A
4,882,473 A 11/1989 Bergeron et al. ..... 235/380
4,889,339 A 12/1989 Okada ..... 273/143 R
4,926,327 A 5/1990 Sidley ..... 364/412
4,937,853 A 6/1990 Brule et al. ..... 379/96
4,963,722 A 10/1990 Takeuchi ..... 235/382.5
5,007,641 A 4/1991 Seidman ..... 273/138 A
5,007,649 A 4/1991 Richardson ..... 273/237
5,016,880 A 5/1991 Berge ..... 273/138 A
5,025,139 A 6/1991 Haliburton, Jr. ..... 235/379
5,038,022 A 8/1991 Lucero ..... 235/380
5,039,848 A 8/1991 Stoken ..... 235/381
5,042,809 A 8/1991 Richardson ..... 273/138 A
5,080,364 A 1/1992 Seidman ..... 273/138 A
5,083,271 A 1/1992 Thacher et al. ..... 364/411
5,096,195 A 3/1992 Gimmon ..... 273/138 A
5,113,990 A 5/1992 Gabrius et al. ..... 194/206
5,119,295 A 6/1992 Kapur ..... 364/412
5,135,224 A 8/1992 Yamamoto et al. ..... 273/143 R
5,159,549 A 10/1992 Hallman, Jr. et al. ..... 364/412
5,179,517 A 1/1993 Sarbin et al. ..... 364/410
5,192,854 A 3/1993 Counts ..... 235/375
5,197,094 A 3/1993 Tillery et al. ..... 379/91
5,222,583 A 6/1993 Bergmann et al. ..... 194/206
5,223,698 A 6/1993 Kapur ..... 235/375
5,265,874 A 11/1993 Dickinson et al. ..... 273/138 A
5,277,424 A 1/1994 Wilms ..... 273/85 CP
5,287,269 A 2/1994 Dorrough et al. ..... 364/408
5,290,033 A 3/1994 Bittner et al. ..... 273/138 A
5,297,802 A 3/1994 Pocock et al. ..... 273/439
5,317,135 A 5/1994 Finocchio ..... 235/375
5,321,241 A 6/1994 Craine ..... 235/380
5,324,035 A 6/1994 Morris et al. ..... 273/138 A
5,332,076 A 7/1994 Ziegert ..... 194/217
5,342,047 A 8/1994 Heidel et al. ..... 273/85 CP
5,348,299 A 9/1994 Clapper, Jr. ..... 273/138 A
5,371,345 A 12/1994 LeStrange et al. ..... 235/380
5,373,440 A 12/1994 Cohen et al. ..... 364/410
5,409,092 A 4/1995 Itako et al. ..... 194/210
5,412,189 A 5/1995 Cragun ..... 235/379
5,429,361 A 7/1995 Raven et al. ..... 273/138 A
5,440,108 A 8/1995 Tran et al. ..... 235/381
5,457,306 A 10/1995 Lucero ..... 235/380
5,470,079 A 11/1995 LeStrange et al. ..... 273/138 A
5,475,205 A 12/1995 Behm et al. ..... 235/375
5,491,326 A 2/1996 Marceau et al. ..... 235/381
5,507,491 A 4/1996 Gatto et al. ..... 273/139
5,536,008 A 7/1996 Clapper, Jr. ..... 463/16
5,551,692 A 9/1996 Pettit et al. ..... 273/143 R
5,559,312 A 9/1996 Lucero ..... 235/380
5,580,310 A 12/1996 Orus et al. ..... 463/16
5,580,311 A 12/1996 Haste, III ..... 463/29
5,609,337 A 3/1997 Clapper, Jr. ..... 273/138.2
5,613,680 A 3/1997 Groves et al. ..... 273/138.2
5,625,562 A 4/1997 Veeneman et al. ..... 364/479.05
5,627,356 A 5/1997 Takemoto et al. ..... 235/381
5,628,684 A 5/1997 Bouedec
5,645,485 A 7/1997 Clapper, Jr. ..... 463/17
5,650,761 A 7/1997 Gomm et al. ..... 235/381
5,655,961 A 8/1997 Acres et al. ..... 463/27
5,655,966 A 8/1997 Werdin, Jr. et al. ..... 463/25
5,674,128 A 10/1997 Holch et al. ..... 463/42
5,735,432 A 4/1998 Stoken et al. ..... 221/1
5,737,418 A 4/1998 Saffari et al. ..... 380/9
5,741,183 A 4/1998 Acres et al. ..... 463/42
5,749,784 A 5/1998 Clapper, Jr. ..... 463/17
5,752,882 A 5/1998 Acres et al. ..... 463/42
5,753,899 A 5/1998 Gomm et al. ..... 235/381
5,770,553 A 6/1998 Kroner et al. ..... 510/360
5,800,269 A 9/1998 Holch et al. ..... 463/42
5,810,664 A 9/1998 Clapper, Jr. ..... 463/17
5,811,772 A 9/1998 Lucero ..... 235/380
5,816,918 A 10/1998 Kelly et al. ..... 463/16
5,820,459 A 10/1998 Acres et al. ..... 463/25
5,839,956 A 11/1998 Takemoto ..... 463/25
5,869,826 A 2/1999 Eleftheriou ..... 235/380
5,902,983 A 5/1999 Crevelt et al. ..... 235/380
5,919,091 A 7/1999 Bell et al. ..... 463/25
5,923,735 A 7/1999 Swartz et al. ..... 379/93.12
5,928,082 A 7/1999 Clapper, Jr. ..... 463/16
5,949,042 A 9/1999 Dietz, II et al. ..... 235/375
5,952,640 A 9/1999 Lucero ..... 235/380
5,954,583 A 9/1999 Green ..... 463/29
5,959,277 A 9/1999 Lucero ..... 235/380
5,984,779 A 11/1999 Bridgeman et al. ..... 463/16
6,012,832 A 1/2000 Saunders et al. ..... 364/410
6,048,269 A 4/2000 Burns et al. ..... 463/25
6,089,982 A 7/2000 Holch et al. ..... 463/42
6,116,402 A 9/2000 Beach et al. ..... 194/216
6,280,326 B1 8/2001 Saunders ..... 463/25
6,280,328 B1 8/2001 Holch et al. ..... 463/42
6,340,331 B1 1/2002 Saunders et al. ..... 463/25

FOREIGN PATENT DOCUMENTS

EP 0 534 718 A2 3/1993

| | | | |
|---|---|---|---|
| GB | 1 558 521 | 1/1977 | ..... G07F/7/08 |
| JP | 63-502702 | 10/1988 | |
| JP | 1-277588 | 11/1989 | |
| JP | 3-242179 | 10/1991 | |
| JP | 4-51982 | 2/1992 | |
| JP | 4-53580 | 2/1992 | |
| JP | 4-174693 | 6/1992 | |
| JP | 4-189384 | 7/1992 | |
| JP | 4-338477 | 11/1992 | ..... A63F/7/02 |
| JP | 4-373097 | 12/1992 | ..... G07G/1/12 |
| JP | 5-184724 | 7/1993 | |
| WO | 81/01664 | 6/1981 | ..... A63B/71/06 |
| WO | WO 87/05425 | 9/1987 | |
| WO | 92/20415 | 11/1992 | ..... A63F/7/02 |
| WO | 98/16910 | 4/1998 | |

OTHER PUBLICATIONS

Declaration of Jeffrey Lindo dated Jul. 2000 and filed in Patent Office in connection with U.S. patent No. 4,575,622.

Denis, A. and Kinsner, W. "Secure and Resilient Data Printed on Paper" Department of Electrical and Computer Engineering, University of Manitoba, Winnipeg, Manitoba, Canada, 1999, (pp. 245–248).

Griffin, Jeffrey A. "Privacy and Security in the Digital Age" Computer Information Systems and Technology, Purdue University, 1998 (pp. 135–137).

Information Disclosure Statement dated Jan. 22, 1993.

"Kenilworth Systems Corporation" *BARRON'S*, Aug. 4, 1980.

"New Brunswick's Video Lottery Off and Running," *Play Meter*, Feb. 1991 (p. 15).

Record Display from the Software Patent Institute Database of Software Technologies, http://m.spi.org, Re'cord I of Serial No. TDB0296.0079, dated Feb. 6, 2002.

Rosen, Richard, "Video Gambling? You Bet You can!" *Daily News*, Aug. 4, 1980.

Roulabette Booklet, 1979 (p. 1–42).

"Single Room, Private Bath–and Blackjack" *The New York Times*, Business and Finance Section, Aug. 21, 1980.

Stockel, Anna "Securing Data and Financial Transactions" Identix Incorporated, Sunnyvale, California, 1995 (pp. 397–401).

Tannenbaum, Jeffrey A., "New Way to Play: Gambling on Credit In Your Own Room" *The Wall Street Journal*, Jul. 31, 1980.

May 23, 1994 reply to Office Action mailed Dec. 22, 1993.

Dec. 2, 1996 reply to Office Action.

GAMING SYSTEM WITH TICKET-IN/ TICKET-OUT CAPABILITY

This patent is a continuation of U.S. Ser. No. 09/541,180 filed Apr. 3, 2000, which is a continuation of application Ser. No. 08/007,742, filed Jan. 22, 1993, now U.S. Pat. No. 6,048,269.

BACKGROUND

At the current time, gaming apparatus, including slot machines, pinball machines and other coin-operated games, typically use coins to operate the machines. The coins are inserted in a slot in the gaming apparatus and the player then operates the gaming apparatus based on the value of the coins deposited. Some gaming apparatus, rather than dispensing the player's winnings after each play, store the value of the winnings and indicate the remaining "credit" of the player. When the player wishes to stop playing, the coins are then dispensed into an external tray of the gaming apparatus. While the present invention is described in relationship to a slot machine the term "slot machine" is used to denote any gaming apparatus that receives money in some form and pays out money or credits.

In some instances, such as when the amount of the winnings exceeds the stored coins within the slot machine, an attendant is notified that additional payment is necessary.

The use of coins in the casino operation for the playing of slot machines has presented a great number of well-known problems that over the years casinos have attempted to eliminate. These problems, among others, are: (1) coins take up a lot of space and have to be frequently emptied from the slot machine, requiring the play of the slot machine to be interrupted; (2) a security guard is required to be present, together with someone to physically move the coins to a central location; (3) the coins then have to be separated, counted, stored and rolled for reuse; (4) coins are heavy and bulky. The amount collected in a typical day at an average casino may weigh more than two tons; (5) coins are dirty; and (6) coins required to operate slot machines represent an inventory (working capital) need of several million dollars. Each of the above tasks takes a substantial amount of time, resources, and costs money. The collecting, counting and depositing of the coins may involve dozens of people.

In addition to the problems with the physical collection of the coins, there are additional problems associated with the operation of slot machines which use coins. The coins take up a lot of space within the slot machines and the slot machines must be designed so as to incorporate space for storing the coins. The use of coins to play slot machines involves a great number of transactions, including getting change for paper currency. This requires numerous change attendants to constantly walk around near the slot machines so that the players do not have to leave the machines. Also containers have to be given to the players for carrying the coins to and from the slot machines. Paper wrappers from the coins are thrown on the ground near the slot machines. Also coins have to be counted by the change attendants after the players stop playing.

There are slot machines that accept coupons or accept paper currency. However, such slot machines also accept coins.

To overcome some of the above disadvantages in using coins for slot machines, there have been a number of attempts to devise a system of money-free slot machines.

The principal approach has been to use some form of credit card or debit card having a user identification code that is inserted into the slot machine, and by use of a central processing unit the identification of the user and the amount of credit available to the user is controlled. A debit card is a card issued by a casino based on a prior cash deposit by the player, much in the same way used in some modem subway systems.

One system uses credit or debit cards having a magnetic strip representing a predetermined value, which can be read by a slot machine equipped with a credit card reader, in place of money. The credit card reader is connected to a central processing unit that determines the value of the card and the value of play.

While the above systems avoid the use of money, they are susceptible to certain abuses which have made them generally unacceptable to the casino industry. Predetermined credit or debit cards are inconvenient and require the casino to establish credit limits for the user, and are susceptible to counterfeiting or use by an unauthorized person. Some identification or other means of assuring the validity of the cards or user is necessary. As a result, these systems do not permit the user to treat the predetermined credit cards as though the cards were money. This changes the gambling habits of the player, which is undesirable.

In the patent to Kapur, U.S. Pat. No. 5,119,295 a lottery ticket dispensing apparatus is disclosed which operates by use of paper currency, credit cards or pay slips. The player obtains a pay slip upon payment of money. The pay slip is coded and can then be inserted into its lottery gaming apparatus. The apparatus prints out a lottery ticket, but has no means for printing any slip corresponding to a winning lottery ticket.

SUMMARY OF INVENTION

In one aspect, the invention is directed to a gaming system, comprising: a first slot machine, comprising: a player input device that allows a player to select a game parameter; game software that allows a player to play a casino game; a printing apparatus that prints a visually perceptible image having a monetary value associated therewith on a ticket; and a reading device that is capable of reading said visually perceptible image printed on said ticket when said ticket is inserted into said reading device for the purpose of activating said slot machine; a second slot machine, comprising: a player input device that allows a player to select a game parameter; game software that allows a player to play a casino game; a printing apparatus that prints a visually perceptible image having a monetary value associated therewith on a ticket; and a reading device that is capable of reading said visually perceptible image printed on said ticket by said printing apparatus of said first slot machine; a host computer comprising: a central processing unit; a memory; and a computer program, said host computer being programmed to store data relating to said visually perceptible image printed by said printing apparatus of said first slot machine; said host computer being programmed to receive data from said reading device of said second slot machine, said received data having been generated in response to inspection by said reading device of said second slot machine of said visually perceptible image that was printed by said printing apparatus of said first slot machine; said host computer being programmed to determine whether credit should be authorized by comparing said stored data with said received data; and said host computer being programmed to transmit a signal to said second slot machine, if credit should be authorized as determined by said host computer, to authorize credit to allow play of said second slot machine.

In the gaming apparatus of the present invention a slot machine which does not use coins is described. Slot machines are typically activated initially by the insertion of coins into the slot machine through a slot, thus the origin of the name "slot machine."

In the present invention no coins are inserted into the slot machine. The slot machine of the present invention includes an optical paper currency reader that is capable of recognizing and validating paper currency and providing the player with the credit corresponding to the value of the currency.

The slot machine of the present invention also includes a bar code reader that can read and validate pre-printed free play coupons, or printed cash out slips previously printed by the gaming apparatus with a bar code representing the value of the coupon or cash out slip. The slot machine also includes a printer that prints and dispenses cash out slips having the value of the cash out slip represented by a bar code. The printer is controlled by a Central Processing Unit (CPU) associated with the slot machine.

Each individual slot machine includes a commercially available Universal Interface Board (UIB) that collects the slot machine data, such as the codes from the bar codes and the output of the paper currency reader and formats it and then transmits it to the CPU. The CPU is located in a secured office at the casino. The printed cash out slips can be accepted by the slot machines in order to obtain credit to play the slot machine or can be inserted or scanned into a separate device at a change station to obtain actual currency.

The bar code representing the value of the free play coupon or cash out slip is augmented by a unique control number randomly generated by the CPU in a well-known manner. When the coupon or cash out slip is put into the bar code reader, the CPU verifies the validity of the individual coupons and cash out slips by verifying the unique control number. Additionally, control numbers for free play coupons can be generated externally and then entered into the CPU as a valid code.

The use of the above system in association with electronic gaming machines eliminates the necessity of having slot machines dedicated to a particular amount of wager. At the present time, the typical casino has slot machines that are dedicated to accept only one value of coin. For example, a slot machine may be a 25 cent machine, accepting only quarters; a 5 cent machine; or a dollar machine. It is very time consuming to physically change the slot machine, which may be desirable during a major event or New Years Eve, when slot machines having higher wager limits are desirable. By use of the subject system, it is possible to change the wager limits of any or all of the individual slot machines. Thus, the minimum wager of the slot machine can be changed at any time. It would also be possible to allow the player to select the wager limit.

This permits the casino operators to increase the usefulness of the slot machines to the casino. Previously one player desiring high wager limits than a companion would have to be separated, since the higher limit machines would be separated from the lower limit machines. The current system permits high limit machines to be next to lower limit machines, since all machines can have the values selected by the player.

Customers playing machines of different wagering limits may elect to participate in common jack pot. This will eliminate progressive carrousels from competing against themselves within the casino.

Another feature of the present invention that is advantageous to the casino is the tracking of the amount of use of the slot machines by a particular player. This is important to a casino which frequently provides perks to customers that use the casino to a significant extent. If the amount of dollars that are being played by a player is desired to be tracked, the player can insert a room key, which in the preferred embodiment is in the form of a card which has a magnetic code on it, into the slot machine which would serve to identify the player. The CPU would then store the amount of play, time and/or money, and/or the individual player. The CPU would-stop tracking the individual player when a cash out slip was generated. This system provides a complete accounting of customer accounts. Since the room key or card is only used for the identification of the player and not for providing credit, the security difficulties and interference that is experienced with the other proposals described above are not encountered. If no room key or the like is inserted, the slot machine still operates, but the player is not tracked. Other player identification means besides a room key could be used, such as providing a special identification card to the player, or having a key pad or the like with the player inserting his identification code. Once a player has inserted an identification card into a slot machine, that player can then be tracked by the insertion of any cash out slip generated by the slot machine for that player. The player would not have to insert the identification card into a slot machine as long as the player had a cash out slip.

At separate locations from the slot machines would be a "Cashiers Station" controlled by the CPU. The Cashiers Stations would not have any gaming function. In the preferred embodiment of the present invention, the Cashiers Station would pay players the value of the cash out slips. However, it is possible for the Cashier Station to provide cash tickets for use in the slot machines in exchange for currency credit card or other cash equivalents. Normally players would deposit paper currency directly into the slot machine and receive a cash out slip for the unused portion and/or winnings at the end of play. In another alternative embodiment, if a player only had coins available, then the Cashiers Station would permit the player to convert the coins to a cash out slip that could be deposited into the slot machine. Having the Cashier Station accept coins from the players would limit the collection of coins to limited locations. Also, since the slot machines would be accepting paper currency directly, many less coins would be deposited in the Cashier Station. The Cashier Station also could accept cash out slips and dispense currency by an automatic money dispenser. Some ATM devices instead of dispensing cash will dispense coupons.

The above described system overcomes the disadvantages of the prior cashless systems. The concern over counterfeiting of individual cash out slips is eliminated because the CPU will be able to keep track of the unique random number for each cash out slip or coupon. When a cash out slip or coupon is entered into the bar code reader, the CPU will determine the validity of the code, and if invalid for any reason, such as it already having been used or cashed, the CPU would not give any credit for the cash out slip or coupon and a silent alarm would be used to alert security personnel to go to the specific slot machine when an invalid code was attempted to be used.

In effect, the system of the present invention permits the player to use the gaming machines in exactly the same manner as if the player was using money. This means that the player does not have to change any playing habits, a very significant factor.

DETAILED DESCRIPTION OF THE DRAWINGS

Figure 1:
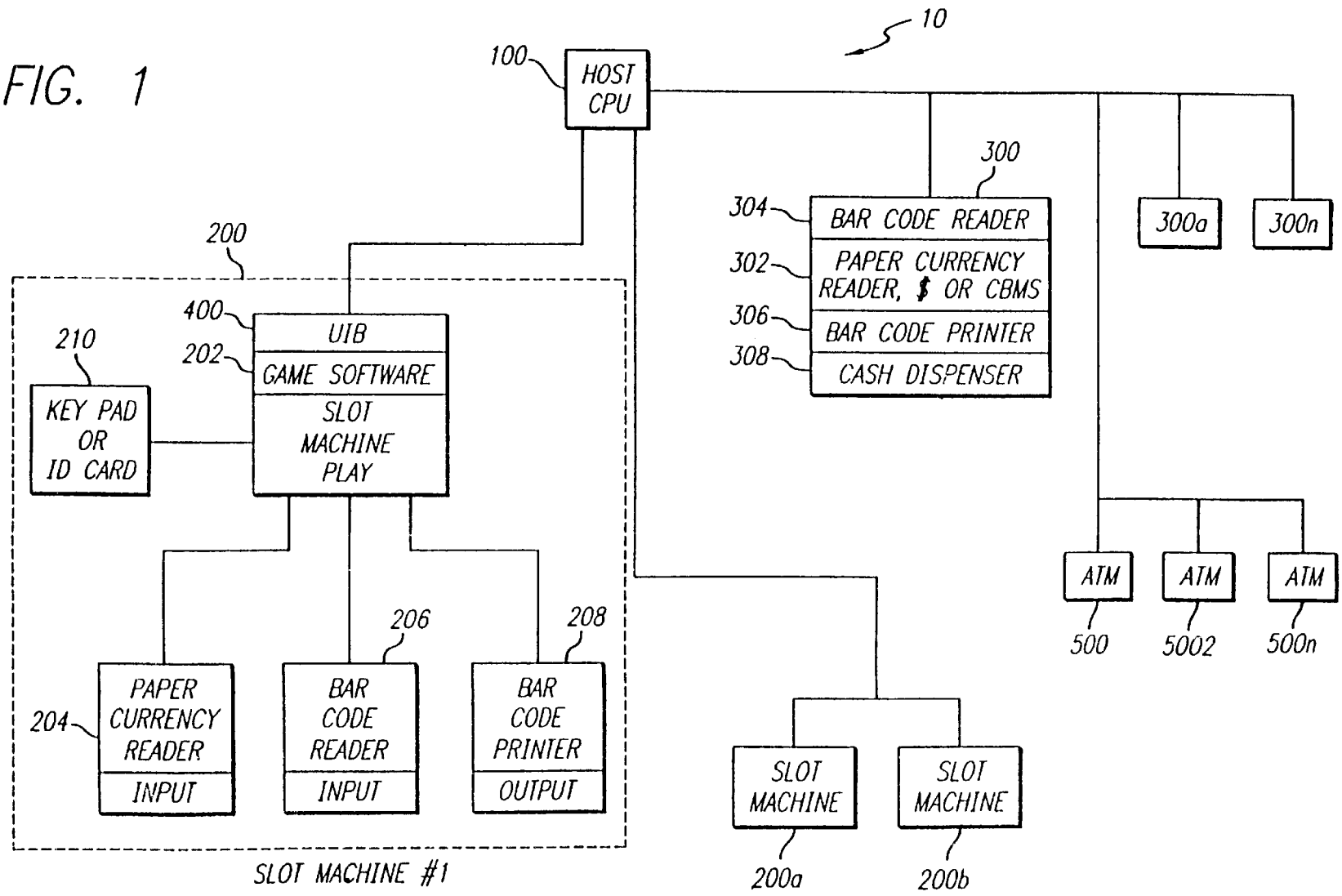
FIG. 1 is a diagrammatic block diagram of the system of the present invention.

Referring to FIG. 1, the block diagram of the components of the invention are shown. The system 10 comprises components all of which are currently available from existing technology. The system itself is referred to as a coinless gaming system and is referred to generally by reference 10.

Figure 5A:
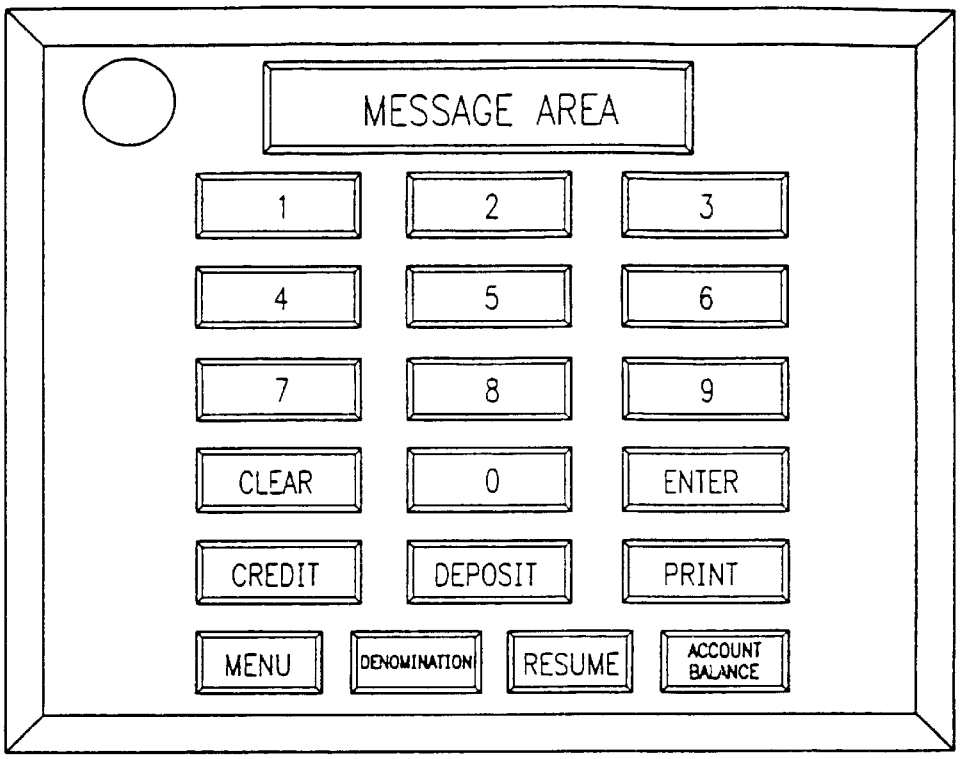
FIGS. 5*a* and 5*b* are exemplars of typical menu screens capable of being displayed with the gaming apparatus of the present invention.
Figure 5B:
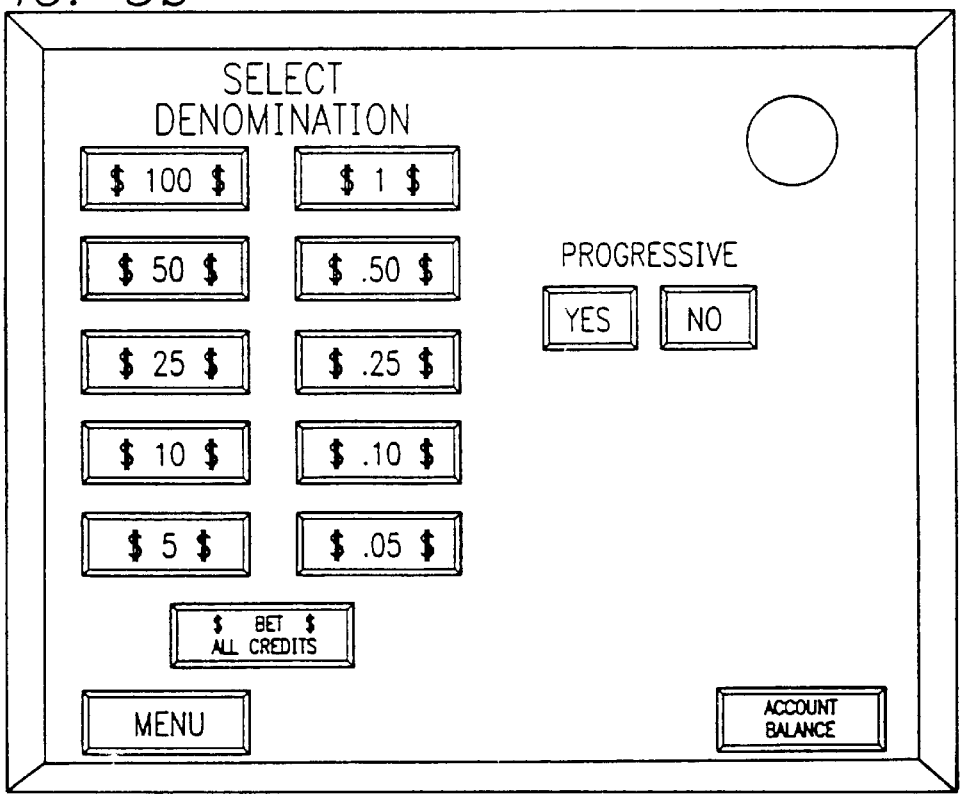

The coinless gaming system is controlled by a host central processing unit (CPU) 100 consisting of a stand-alone computer having all of the conventional attributes of a general-purpose computer. In the preferred embodiment a status brand fault-tolerant computer is used. The CPU 100 is connected to a series of gaming apparatus, such as slot machines 200, 200*a* . . . n. The play of the slot machine 200 is controlled by internal game software 202 with preset parameters for the play of the game. In the preferred embodiment the desired game to be played is selected from a touchscreen-operable menu (shown in FIGS. 5*a* and 5*b*) whereby the player can select the particular game that the player wishes to play, as well as other options, such as the amount of the wager. For example, the menu may provide the player with the options of playing blackjack, conventional slots, poker, horse racing, roulette, or any other game available on software. The player can also select the amount of the wager, for example in units of 25 cents, $1.00 or any other amount permitted by the menu. The technology for touch screen menu-driven devices is known. Such touch screen of the present invention is sold commercially by Video Gaming Technology, Inc. and others. The CPU 100 controls the various menu-driven options, such as game selection and amount of the wager for the game.

The slot machine 200 includes a first input means in the form of a paper currency reader 204. The paper currency reader provides a signal to the CPU 100 indicating that it is valid currency and value of the currency. The CPU then authorizes the appropriate credit to the gaming apparatus. The paper currency reader 204 is well known in the trade and is commercially available from numerous companies, including J.C.M.

While in the preferred embodiment the paper currency reader 204 will be limited to United States paper currency, it is possible to have several different paper currency readers or one reader that recognize a variety of international currencies. The CPU 100 can have the current exchange rates for purposes of determining the credit available to the player.

Figures 2, 3, 4:
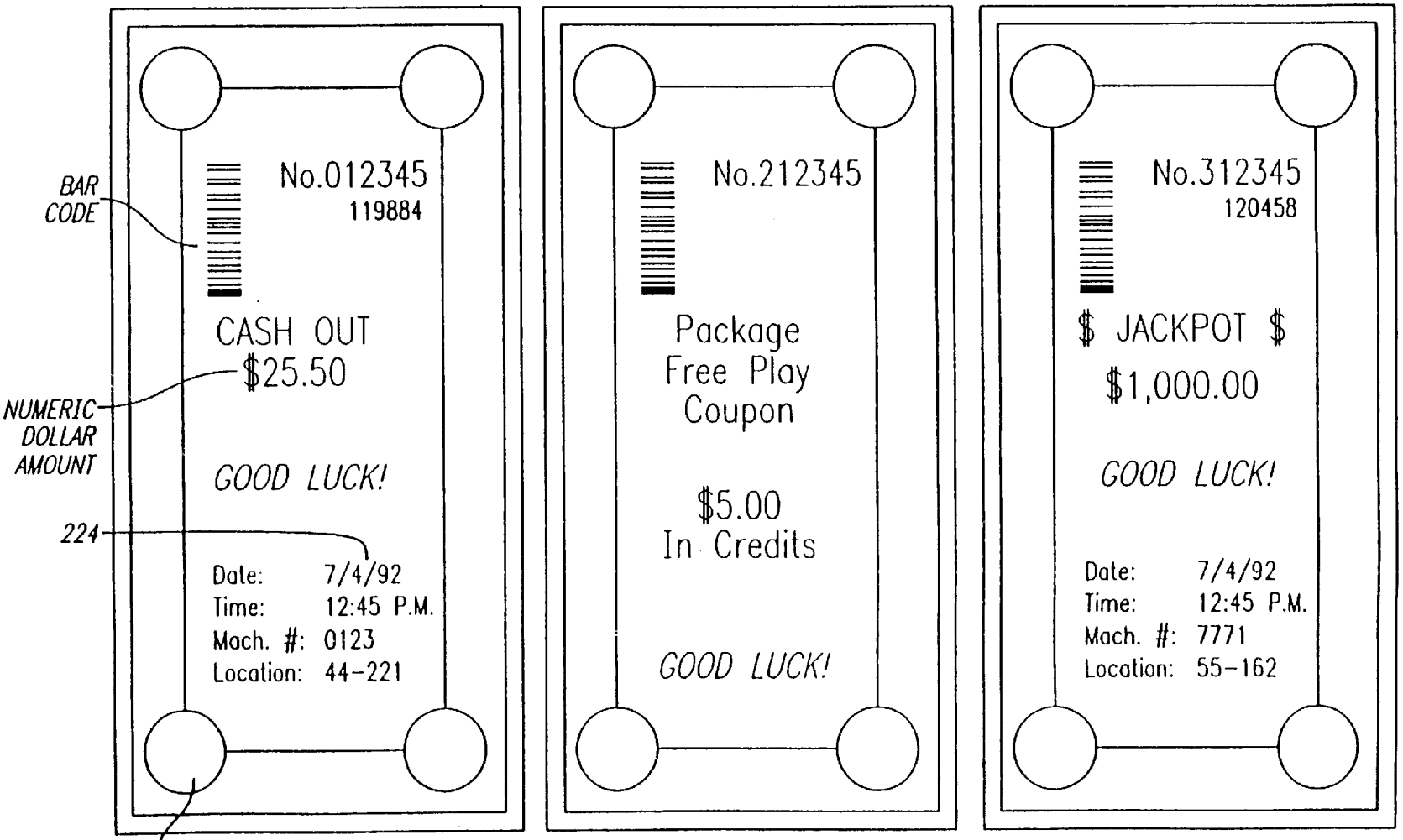
FIG. 2 is an exemplar of a typical cash out slip from the gaming apparatus of the present invention.
FIG. 3 is an exemplar of a coupon capable of being used with the gaming apparatus of the present invention.
FIG. 4 is an exemplar of a jackpot winner cash out slip from the gaming apparatus of the present invention.

The slot machine 200 has a second input means in the form of a bar code reader 206. The operation of bar code readers is well known and in the preferred embodiment a bar code reader commercially available from Triad is used. While in the preferred embodiment the bar code is inserted in the form of a permanent storage means, such as on a paper cash out slip, such as shown in FIG. 2, or free play coupon shown in FIG. 3, or Jackpot pay out ticket shown in FIG. 4, each of which has a bar code on the ticket for reading by the bar code reader, it is recognized that other forms of codes can be used in its place, such as coded magnetic strips on plastic cards.

While in most cases the free play coupons will be in the form of a monetary value, preprinted free play coupons not having money values associated with them, but other forms of play are possible. For example, the coupon may be used to permit the player to compete in a contest for the best hand in a casino wide poker contest, or other promotional purposes.

In the preferred embodiment, the paper currency reader 204 and the bar code reader 206 are located within the housing of the slot machine 200 so that the free play coupons, cash out slips and paper currency are all entered within a single slot and stored on top of each other in a single lock box that would be removable from the slot machine by authorized personnel. However, it is also possible to have the paper currency deposited in a separate slot from the free play coupons or cash out slips and stored separately.

The slot machine also includes a bar code printer 208 for printing cash out slips 220 having bar codes 222 on a permanent storage medium, such as paper, which is stored within the housing. In addition to the bar code, the cash out slip 220 may also contain other information such as the date 224 of the print out of the cash out slip 222. A simple roll of preprinted cash out slips should be sufficient to generate from 400 to 800 cash out slips. A sensor can signal the CPU 100 when only ten percent (10%), or some other amount, of the coupons are remaining so that the paper can be changed. The printer 208 prints a bar code as directed by the CPU 100. Such printers are well known. In the preferred embodiment of the present invention the bar code printer 208 is commercially available from Star Micronics.

The printer 208 prints a bar code 222 on the cash out slips 220 responsive to the instructions from the CPU 100. The CPU 100 generates the bar code to be printed. The bar code 222 represents the monetary value of the value of the credit stored in the particular slot machine 200 on the cash out slips 220, along with a randomly generated number in order to permit the CPU 100 to verify the validity and unique identification of the cash out slip 220 at a later time. This is necessary since the bar code cash out slip 220 is capable of being inserted as an input into the bar code reader 206. Upon insertion- of the cash out slip 220 into the bar code reader 206, the bar code reader 206 transmits a signal to the CPU 100 corresponding to the bar code, and the CPU 100 compares the bar code 222 on the particular cash out ticket with those stored in its memory which contains the value of the cash out slip, the unique identification, and its status. For example, the status may be "paid," in which case the cash out ticket will be considered invalid and no credit will be given for the cash out slip. Since the CPU 100 has randomly generated the unique identification, a cash out ticket can receive credit only once. The options available if the code is invalid are: (1) the slot machine will merely reject the cash out slip if it does not have any readable code, such as would be the case if it was blank paper; or (2) if there is a readable bar code, but one that is an invalid code, security will be called.

In an alternative embodiment of the present invention, when paper currency, a cash out slip or a free play coupon is inserted as an input into a slot machine 200, a status indicator in the form of a visual display of the amount of the value of the ticket, currency or free play coupon will appear on the screen, as shown in FIG. 5, with a query to the player to verify that this is the right amount. If it is not the right amount or there is some other error, then the player would be directed to call an attendant.

A third input to the CPU can be a player identification code reader 210 which is capable of reading a room key or specially encoded identification card, such as one having a magnetic strip, for identifying the player using the slot machine 200. This identification card is intended to permit the CPU 100 to keep track of the player and the amount of time and/or money played by the identified player. The identification card is not intended to provide the player with credit so the concern over the security of the card is not significant, as would be the case if the identification card provided the player with credit or was used to store the amount of winnings of the card holder.

The identification card reader 210 input can also be a key pad which the player would use to enter a number or some other means of identification. Such key pads are well known and are commercially available.

Also associated with the CPU 100 are one or more change stations 300, 300*a* . . . n or convenient ATM 500, 500*a* . . . n devices which instead of dispensing cash, generate a coupon usable with the slot machines 200. In the preferred embodiment, the change station 300 consists of a second bar code reader 304 that accepts cash out slips 222. The validity of the cash out slip 222 is verified by the CPU 100, and if valid, paid for by the attendant. Other security devices, such as holograms and the like that can be visually inspected to provide further security may be employed as well.

In an alternative embodiment, the change station can be more automated. The change station 300 in an alternative embodiment consists of a second paper currency reader 302, a second bar code reader 304, and a second bar code printer 306 for printing bar codes on a permanent storage medium. The second currency reader 302, second bar code reader 304, and second bar code printer 306 are the same as used in the slot machine 200. The change station 300 also includes a currency dispenser 308 so that when a cash out slip 222 is inserted into the bar code reader 306, then paper currency and coins can be dispensed directly to the user. In an alternative embodiment, a coin receiver is capable of accepting coins from a player in order to print cash out slips having a bar code, in the same manner that the slot machine 200 would print out cash out slips, that could be used with the slot machines 200.

As is the case with the slot machine 200, in the event that a cash out slip 222 is inserted into the bar code reader 304, the CPU 100 will validate the cash out slip 222 by making sure that it had not already been paid or otherwise valid. If it is valid then the currency would be paid out by the change station attendant. The attendant could be advised of the amount of currency to be paid to the player by a monitor display or a receipt printer, such is used in cash registers. Such receipt printers are well known.

The CPU 100 is fed signals generated by the Universal Interface Board (UIB) 400 which acts as the interface between the slot machine 200 and the CPU 100. The UIB is a commercially available interface which is widely used in the gaming industry to control the operation of existing stand-alone electronic gaming apparatus. In the preferred embodiment of the present invention, the Universal Interface Board is sold by Five Star Solutions, Inc.

The UIB consists of an electronic chip which collects all of the slot machine data, organizes and formats it, and then transmits the organized data to the CPU 100. The UIB 400 also acts as a controller for the operation and functions of the bar code reader 206, the printer 208, the paper currency reader 204, the player identification input and other peripherals associated with the slot machines. The UIB 400 is capable of being changed by the CPU 100 to alter any of its functions. Standard computer programming, such as is well known to computer programmers in the gaming industry, is used to select the particular parameters designed to be employed in the operation and control of the UIB 400 and the CPU 100.

While in the preferred embodiment, printed bar codes are used as the encoding means, it is also possible to use other coding means, such as magnetic codes on magnetic strips on plastic cards. The cards would be treated the same as cash out slips, but would require magnetic code readers and magnetic code generators rather than bar code readers and bar code printers.

While the present invention has been described in detail with regards to the preferred embodiment, it is appreciated that other variations of the present invention may be devised which do not depart from the inventive concept of the present invention.

We claim:

1. A gaming system, comprising:

a first slot machine, comprising:

a player input device that allows a player to select a game parameter;

game software that allows a player to play a casino game;

a printing apparatus that prints a visually perceptible image having a monetary value associated therewith on a ticket; and a reading device that is capable of reading said visually perceptible image printed on said ticket when said ticket is inserted into said reading device for the purpose of activating said slot machine;

a second slot machine, comprising:

a player input device that allows a player to select a game parameter;

game software that allows a player to play a casino game;

a printing apparatus that prints a visually perceptible image having a monetary value associated therewith on a ticket; and a reading device that is capable of reading said visually perceptible image printed on said ticket by said printing apparatus of said first slot machine;

a host computer comprising:

a central processing unit;

a memory; and a computer program, said host computer being programmed to store data relating to said visually perceptible image printed by said printing apparatus of said first slot machine;

said host computer being programmed to receive data from said reading device of said second slot machine, said received data having been generated in response to inspection by said reading device of said second slot machine of said visually perceptible image that was printed by said printing apparatus of said first slot machine;

said host computer being programmed to determine whether credit should be authorized by comparing said stored data with said received data; and said host computer being programmed to transmit a signal to said second slot machine, if credit should be authorized as determined by said host computer, to authorize credit to allow play of said second slot machine.

2. A gaming system as defined in claim 1 wherein said host computer is programmed to determine whether credit should be authorized by determining whether a monetary amount associated with said visually perceptible image printed by said printing apparatus of said first slot machine has previously been paid.

3. A gaming system as defined in claim 1 wherein said host computer is programmed to determine whether credit should be authorized based on a control number associated with said ticket inspected by said reading device of said second slot machine.

4. A gaming system as defined in claim 1 wherein said host computer is additionally programmed to receive player identification data from said first slot machine.

5. A gaming system as defined in claim 1 wherein said first slot machine additionally comprises a value input device in the form of a paper currency reader.

6. A gaming system as defined in claim 1 wherein said visually perceptible image printed by said printing apparatus of said first slot machine comprises a bar code image and wherein said printing apparatus of said first slot machine prints said bar code image.

7. A gaming system as defined in claim 1 wherein said visually perceptible image printed by said printing apparatus of said first slot machine comprises a bar code image that represents a control number and wherein said printing apparatus of said first slot machine prints said bar code image.

8. A gaming system as defined in claim 1 wherein said visually perceptible image printed by said printing apparatus of said first slot machine comprises a bar code image that represents a monetary value and wherein said printing apparatus of said first slot machine prints said bar code image.

9. A gaming system as defined in claim 1 wherein said visually perceptible image printed by said printing apparatus of said first slot machine comprises a bar code image that represents a cash out value and wherein said printing apparatus of said first slot machine prints said bar code image.

10. A gaming system as defined in claim 1 wherein said game software of one of said slot machines comprises software that allows a player to play one of the following games: blackjack, slots or poker.

11. A gaming system as defined in claim 1 wherein one of said game parameters comprises a wager amount and wherein said player input device of said first slot machine allows a player to select one of a plurality of wager amounts.

12. A gaming system as defined in claim 1 wherein said first and second slot machines comprise coinless slot machines.

* * * * *

UNITED STATES PATENT AND TRADEMARK OFFICE

CERTIFICATE OF CORRECTION

PATENT NO. : 6,729,958 B2
DATED : May 4, 2004
INVENTOR(S) : James Burns et al.

It is certified that error appears in the above-identified patent and that said Letters Patent is hereby corrected as shown below:

Title page,
After Item [73], Inventors, please insert -- This patent is subject to a terminal disclaimer. --

Column 1,
Line 22, please delete “machine” and insert -- machine, -- therefor.

Column 4,
Lines 9-10, please delete “would-stop” and insert -- would stop -- therefor.

Column 6,
Line 41, please delete “insertion-” and insert -- insertion -- therefor.

Signed and Sealed this

Twelfth Day of October, 2004

JON W. DUDAS
*Director of the United States Patent and Trademark Office*